United States Patent [19]

Stacey

[11] Patent Number: 4,604,512

[45] Date of Patent: Aug. 5, 1986

[54] HEAT EXCHANGER TUBE REPAIR

[75] Inventor: John Stacey, Breightmet, England

[73] Assignee: United Kingdom Atomic Energy Authority, London, England

[21] Appl. No.: 596,723

[22] Filed: Apr. 4, 1984

[30] Foreign Application Priority Data

May 13, 1983 [GB] United Kingdom ..... 8313266

[51] Int. Cl.[4] ..... B23K 1/04

[52] U.S. Cl. ..... 219/85 M; 219/60.2; 228/119

[58] Field of Search ..... 219/85 M, 85 R, 85 D, 219/85 E, 85 A, 60.2; 228/119

[56] References Cited

U.S. PATENT DOCUMENTS

| | | | |
|---|---|---|---|
| 3,118,052 | 1/1964 | Lippart et al. | 219/60.2 X |
| 4,283,615 | 8/1981 | Vrillon | 219/66 |
| 4,448,343 | 5/1984 | Kochka et al. | 228/119 X |
| 4,521,664 | 6/1985 | Miller | 219/76.14 |

FOREIGN PATENT DOCUMENTS

| | | | |
|---|---|---|---|
| 75722 | 4/1983 | European Pat. Off. | 228/119 |
| 1170434 | 5/1964 | Fed. Rep. of Germany | 29/157.4 |
| 142339 | 12/1978 | Japan | 228/119 |
| 2032559 | 5/1980 | United Kingdom | 285/286 |

OTHER PUBLICATIONS

Olds, F. C. "Sleeving Saves Nuclear Steam Generator Tubes", *Power Engineering*, Dec. 1981, pp. 73–75.

*Primary Examiner*—Clarence L. Albritton
*Assistant Examiner*—C. M. Sigda
*Attorney, Agent, or Firm*—William R. Hinds

[57] ABSTRACT

In the repair of a leaking heat exchanger tube (10) with a repair tube (11) at a braze (12), strain in the exchanger tube (10) is relieved during the brazing operation. Where the exchanger tube is of U-shape both legs (10A and 10B) are treated similarly. Strain relief could also be obtained by a thinning and bulging operation in the exchanger tube at a region which also receives heat from the brazing operation so, on brazing, yield takes place at the bulge.

5 Claims, 4 Drawing Figures

HEAT EXCHANGER TUBE REPAIR

This invention relates to the repair of heat exchanger tubes.

CROSS REFERENCE TO RELATED APPLICATION

Reference is made to commonly assigned copending application Ser. No. 596,720 of even date in the names of Roach et al.

BACKGROUND OF THE INVENTION

There is currently a problem in the nuclear field, and probably in other fields, where a leak at a tube in a nest of tubes where it is welded to a tube plate in a heat exchanger has to be made good without gaining access to the outside of the tube. The known practice for dealing with this problem is to insert a length of repair tube into the leaking tube through the tube plate with one (the outer) end of repair tube explosively welded to the tube plate and the other (the inner) end brazed to the leaking tube.

We have now discovered that the quality of the braze can be effected by the prescnce of stress in the tube being repaired, such stress arising during the heating necessary to effect the braze.

Said application Ser. No. 596,720 of even date in the names of Roach et al provides a method of repairing a leaking heat exchanger tube at its weld with a tube plate comprising the insertion of a length of repair tube into the leaking tube through the tube plate with the outer end of the repair tube explosively welded to the tube plate and the inner end brazed to the leaking tube characterised in that, prior to effecting the repair, the leaking tube is subjected to a strain-on-heating test.

Said copending application also provides apparatus for carrying out the above method.

Investigating the strain-on-heating matter further we have found that some degree of strain always exists. A basic strain arises from the fact that one leg of a U-shaped heat exchanger tube is being heated whilst the other leg is not. The magnitude of this basic strain tends to be related to the spacing apart of the legs of the U-shape: a wide spacing gives low strain whilst a close spacing gives a higher strain. Strains can also arise on heating due to binding between a tube and tube support plate.

FEATURES AND ASPECTS OF THE INVENTION

The present invention provides, in the method of repairing a leaking heat exchanger tube at its weld with a tube plate comprising the insertion of a length of repair tube into the leaking tube through the tube plate with the inner end of the repair tube brazed to the leaking tube, the step of providing means whereby strain in the leaking tube is relieved when subject to the heat of the braze.

When the leaking tube is of U-shape, so as to have two legs joined by the base of the U-shape in which one leg is leaking, the means for strain relief may be the heating of the non-leaking leg. Such heating could also involve brazing a further repair tube to the non-leaking leg.

The means for strain relief could also be a weakness zone inserted into the heated tube so that the strain is induced to relieve itself at that zone where the tube is heated.

Problems arise in choosing the best way to create a weakness zone. A weakness created by simple thinning of the tube does not give the required strain relief, neither does cutting nor drilling. Cutting and drilling is also undesirable as it causes loss of back-up containment that the leaking tube provides. This loss also arises if the leaking tube is severed.

Further, in accordance with the invention, the weakness zone is created first by a thinning operation (such as by undercutting) and second by an expansion or bulging operation at the point of thinning. The expansion or bulging can be performed by using an axially compressed recoverable isostatic ring, such as a rubber ring. With such a zone created, strain arising by the heating of the heat exchanger tube relieves itself at least to a degree not affecting the braze.

The invention will now be described further with reference to the accompanying diagrammatic drawings in which.

Figure 1:
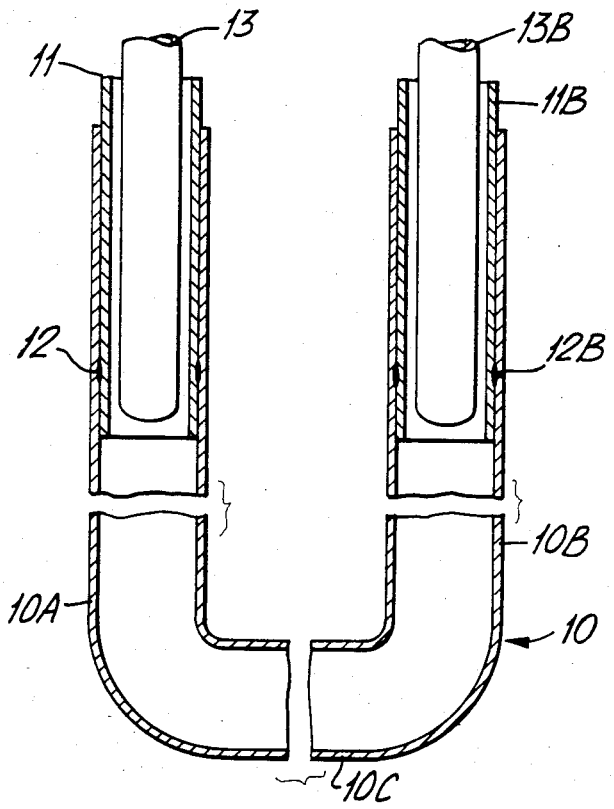
FIG. 1 shows a heat exchanger tube of U-shape in sectional elevation having one leg repaired.

In FIG. 1 a U-shaped heat exchange tube 10 having legs 10A and 10B and a base 10C is assumed to be leaking at the point where the leg 10A is welded to its tube plate (not shown). In order to effect a repair, a repair tube 11 is explosively welded at its upper end to the tube plate and brazed at a braze 12 to the leg 10A. The brazing is performed by heat induced in the braze by a probe form of heater 13 inside the tube 11.

If the heating of the leg 10A takes place without heating the leg 10B correspondingly a strain is set up in both legs as leg 10A expands whilst leg 10B does not. The strain in leg 10B is not critical but that in leg 10A may be if the magnitude of the strain exceeds a limit above which the quality of the braze 12 is affected. To avoid this situation it is arranged that leg 10B is also heated by a second probe form heater 13B. In fact, it is advisable to treat leg 10B exactly like leg 10A and include the brazing of a repair tube 11B at a braze 12B. This not only ensures identity of treatment of the legs but safeguards against strain problems arising should leg 10B eventually leak and need repair.

Figure 2:
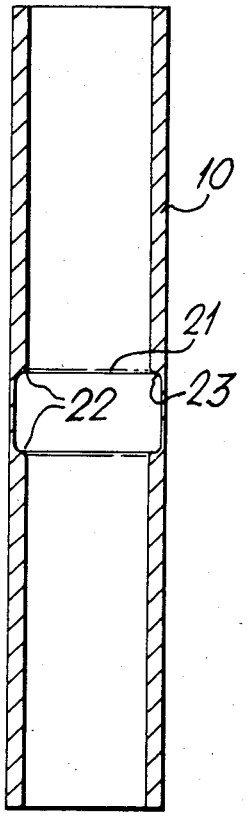
FIGS. 2, 3 and 4 show in sectional elevation the weakening and bulging of a tube prior to being brazed to a repair tube.

In FIG. 2, a leaky heat exchanger tube 10 having an external diameter of 25 mm and a wall thickness of 2.5 mm is given an annular undercut 21 to remove 2 mm of wall thickness over a length of 12 mm. Sharp corners 22 are removed and the undercut has rounded corners 23. The undercut is made above the region at which a braze is to be effected between the tube 10 and a repair tube but close enough to experience the heat of the braze.

Figure 3:
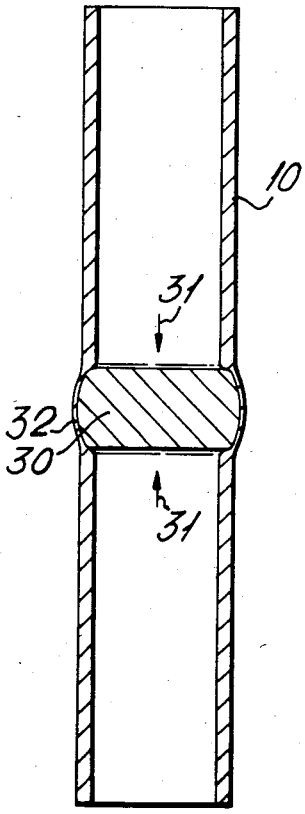

In FIG. 3 a rubber plug 30 is shown subjected to axial compression (arrows 31) so that it expands into the undercut to give the tube 10 a bulge 32 at the undercut.

Figure 4:
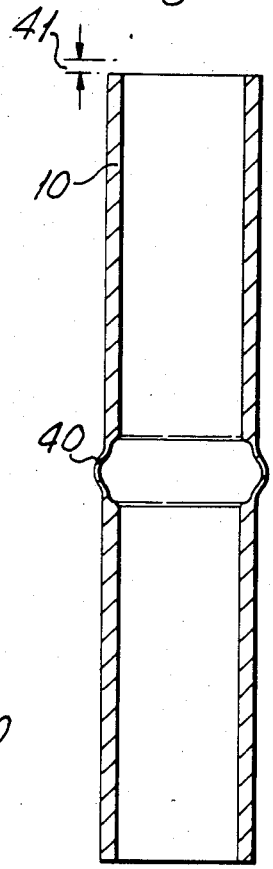

FIG. 4 shows the shape 40 taken by the undercut 21 when the tube 10 yields (arrows 41) 1.5 mm, on being heated due to the fact that the tube 10 is binding in a grid plate or is otherwise stressed. Yield takes place at about 900° C. The braze is effected at about 1000° C. In this way no troublesome axial strain exists in the heat exchanger tube 10 during the course of the braze and hence there is no tendency for the tube 10 to change dimensions under the strain in the region of the braze. Such dimension changing, if it occurs, is believed to cause unsatisfactory brazing as the capillary gap between the tube 10 and the repair tube becomes irregular and the braze metal does not spread uniformly.

I claim:

1. In the method of repairing a heat exchanger tube which is leaking where it is welded to a tube plate comprising the insertion of a length of repair tube into the leaking tube through the tube plate with the inserted inner end of the repair tube brazed to the leaking tube and the other end of the repair tube explosively welded to the tube plate, the step of relieving heat-produced axial strain in the leaking tube while subjecting the leaking tube to the heat produced by the brazing.

2. In the method of repairing a heat exchanger tube which is leaking where it is welded to a tube plate comprising the insertion of a length of repair tube into the leaking tube through the tube plate with the inserted inner end of the repair tube brazed to the leaking tube and the other end of the repair tube explosively welded to the tube plate, the step of relieving heat-produced axial strain in the leaking tube while subjecting the leaking tube to the heat produced by the brazing, wherein the leaking tube is of U-shape so as to have two legs joined by a U-shape base with one leg being brazed to a repair tube, and wherein the step of relieving strain comprises generally simultaneous and corresponding heating of the other leg.

3. The method of claim 2 in which the heating of the other leg also involves brazing a further repair tube to said other leg.

4. In the method of repairing a heat exchanger tube which is leaking where it is welded to a tube plate comprising the insertion of a length of repair tube into the leaking tube through the tube plate with the inserted inner end of the repair tube brazed to the leaking tube and the other end of the repair tube explosively welded to the tube plate, the step of relieving strain in the leaking tube when subjecting the leaking tube to the heat produced by the brazing, wherein the step of relieving strain comprises providing the leaking tube with a weakness zone so that the strain is induced to relieve itself at that zone when the tube is heated.

5. The method of claim 4 in which the weakness zone is generated by thinning of the leaking tube followed by bulging at the thinning.

* * * * *